US009618870B1

(12) United States Patent
Hoshio et al.

(10) Patent No.: US 9,618,870 B1
(45) Date of Patent: Apr. 11, 2017

(54) CHARGING MEMBER, PROCESS CARTRIDGE, AND IMAGE FORMING APPARATUS

(71) Applicant: FUJI XEROX CO., LTD., Tokyo (JP)

(72) Inventors: Takuro Hoshio, Kanagawa (JP); Hiroyuki Miura, Kanagawa (JP); Kosuke Narita, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/009,469

(22) Filed: Jan. 28, 2016

(30) Foreign Application Priority Data

Sep. 24, 2015 (JP) ..... 2015-187162

(51) Int. Cl.
*G03G 15/02* (2006.01)
*G03G 21/18* (2006.01)

(52) U.S. Cl.
CPC ..... *G03G 15/0216* (2013.01); *G03G 21/18* (2013.01); *G03G 15/0233* (2013.01)

(58) Field of Classification Search
CPC ..... G03G 15/0233
See application file for complete search history.

(56) References Cited

U.S. PATENT DOCUMENTS

| | | | | |
|---|---|---|---|---|
| 8,090,298 | B2 | 1/2012 | Hoshio et al. | |
| 2010/0247149 | A1* | 9/2010 | Hoshio | G03G 15/0233 399/176 |
| 2012/0070188 | A1* | 3/2012 | Hirakoso | G03G 15/0233 399/111 |
| 2012/0076532 | A1* | 3/2012 | Hoshio | G03G 15/0233 399/111 |
| 2012/0094223 | A1 | 4/2012 | Kano et al. | |

FOREIGN PATENT DOCUMENTS

| | | | |
|---|---|---|---|
| JP | 6-264918 | A | 9/1994 |
| JP | 7-64378 | A | 3/1995 |
| JP | 2649162 | B2 | 9/1997 |
| JP | 2003-316111 | A | 11/2003 |
| JP | 2003-316112 | A | 11/2003 |
| JP | 2006-163059 | A | 6/2006 |
| JP | 2007-101864 | A | 4/2007 |
| JP | 2008-276022 | A | 11/2008 |
| JP | 2008-276026 | A | 11/2008 |
| JP | 2010-102016 | A | 5/2010 |
| JP | 2010-102197 | A | 5/2010 |
| JP | 2012-88397 | A | 5/2012 |
| JP | 2013-33236 | A | 2/2013 |

* cited by examiner

*Primary Examiner* — Sandra Brase
(74) *Attorney, Agent, or Firm* — Sughrue Mion, PLLC

(57) ABSTRACT

A charging member includes a conductive support and an outermost layer disposed on the conductive support. The outermost layer includes porous silica and an N-alkoxymethylated polyamide and has a gel fraction of 50% or more and a surface roughness Rz of 2 μm or more and 20 μm or less.

10 Claims, 4 Drawing Sheets

CHARGING MEMBER, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2015-187162 filed Sep. 24, 2015.

BACKGROUND (i) Technical Field

The present invention relates to a charging member, a process cartridge, and an image forming apparatus.

(ii) Related Art

In electrophotographic image forming apparatuses, the surface of an image holding member including a photoconductive photosensitive member composed of an inorganic or organic material is charged using a charging device in order to form a latent image, the latent image is developed with a charged toner in order to form a visualized toner image, the toner image is transferred to a recording medium such as recording paper via an intermediate transfer body or directly, and the transferred image is fixed to the recording medium in order to form a desired image.

SUMMARY

According to an aspect of the invention, there is provided a charging member including a conductive support and an outermost layer disposed on the conductive support. The outermost layer includes porous silica and an N-alkoxymethylated polyamide and has a gel fraction of 50% or more and a surface roughness Rz of 2 μm or more and 20 μm or less.

BRIEF DESCRIPTION OF THE DRAWINGS

Exemplary embodiments of the present invention will be described in detail based on the following figures, wherein.

DETAILED DESCRIPTION

Figure 1:
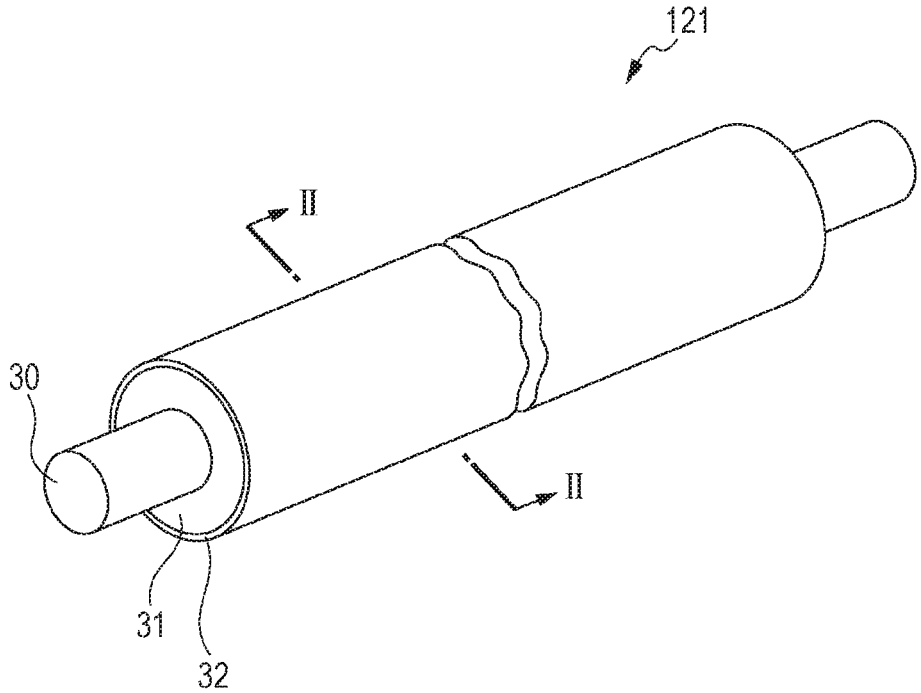
FIG. 1 is a schematic perspective view of an example of a charging member according to an embodiment.

Exemplary embodiments of the invention are described below with reference to the attached drawings.

It should be noted that members having substantially the same function are denoted by the same reference numeral throughout the drawings and the duplicate descriptions and reference numerals thereof may be omitted.

Charging Member

A charging member according to an embodiment includes a conductive support and an outermost layer disposed on the conductive support. The outermost layer includes porous silica and an N-alkoxymethylated polyamide and has a gel fraction of 50% or more and a surface roughness Rz of 2 μm or more and 20 μm or less.

The charging member according to this embodiment has a high capability to uniformly charge a body-to-be-charged and a high capability to maintain the uniform-charging capability throughout the repeated use of the charging member. The reason for this is not clear, but considered to be as follows.

When a charging member that charges the surface of an electrophotographic photosensitive member by being brought into contact with the surface of the photosensitive member is repeatedly used, streak-like image defects may occur. The occurrence of the streak-like image defects is particularly more likely to become pronounced in the case where a charging method in which only a direct-current voltage is applied to the charging member is employed than in the case where a charging method in which an alternating-voltage is applied to the charging member is employed because a negative impact of environment conditions such as temperature and humidity is more likely to occur and the charging member has a lower uniform-charging capability.

However, the N-alkoxymethylated polyamide included in the outermost layer of the charging member according to this embodiment, which undergoes a crosslinking reaction in the presence of an acid catalyst, is likely to undergo a crosslinking reaction and thereby be merged with the porous silica included in the outermost layer because the surfaces of the porous silica particles are acidic and silanol groups are present on the surfaces of the porous silica particles. This reduces the likelihood of the surface of the charging member fracturing due to fatigue when the charging member is repeatedly used and, as a result, enables the charging member to maintain the uniform charging capability over a longed period of time.

Furthermore, the porous silica is considered to enhance the capability of the charging member to uniformly charge a body-to-be-charged because the porous silica is more likely than a porous filler composed of another material such as a polyamide resin or a polyacrylic resin to eject electrons.

Since the outermost layer of the charging member according to this embodiment has a gel fraction of 50% or more, the charging member has high durability to withstand contamination due to external additives included in a toner, paper dust, discharge products, and the like. Moreover, cracking in the outermost layer may be reduced. Since the outermost layer of the charging member according to this embodiment has a surface roughness Rz of 2 μm or more and 20 μm or less, it is considered that the charging member has a high uniform-charging capability at the initial stage and the uniform-charging capability of the charging member is likely to be maintained over a longed period of time.

Therefore, a charging member according to this embodiment is considered to have a high capability to uniformly charge a photosensitive member and thereby reduce the occurrence of the streak-like image defects even in the case where, for example, the charging method in which only a direct-current voltage is applied to the charging member is employed and maintain the uniform-charging capability from the initial stage to the time the charging member is repeatedly used.

The term "conductive" used herein refers to having a volume resistivity of $1\times10^{14}$ Ωcm or less at 20° C.

Figure 2:
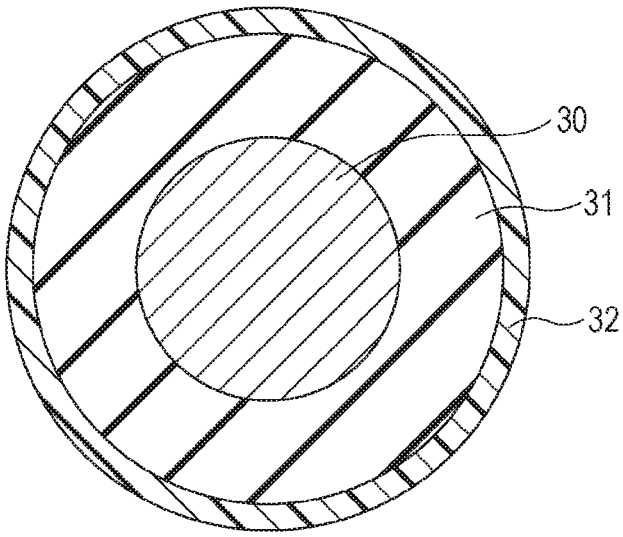
FIG. 2 is a schematic cross-sectional view of an example of a charging member according to an embodiment.

FIG. 1 is a schematic perspective view of the charging member according to this embodiment. FIG. 2 is a schematic cross-sectional view of the charging member according to this embodiment, which is taken along the line II-II of FIG. 1.

As illustrated in FIGS. 1 and 2, the charging member 121 according to this embodiment is a roller member including, for example, a hollow or solid cylindrical support 30 (i.e., shaft), a conductive elastic layer 31 disposed on the outer peripheral surface of the support 30, and an outermost layer 32 disposed on the outer peripheral surface of the conductive elastic layer 31.

The structure of the charging member 121 according to this embodiment is not limited to the above-described one. For example, the conductive elastic layer 31 may be omitted. An intermediate layer (e.g., adhesive layer) may optionally be interposed between the conductive elastic layer 31 and the conductive support 30. A resistance adjustment layer or a transfer prevention layer may optionally be interposed between the conductive elastic layer 31 and the outermost layer 32. The charging member 121 according to this embodiment may be constituted by only the conductive support 30 and the outermost layer 32.

Although a charging member having a roller-like shape is described as an example in this embodiment, the shape of the charging member is not particularly limited to a roller-like shape. The charging member may have any shape such as a roller-like shape, a brush-like shape, a belt (tube)-like shape, or a blade-like shape. Among these shapes, the charging member according to this embodiment preferably has a roller-like shape. In other words, the charging member is preferably a charging roller.

The components of the charging member 121 according to this embodiment are described in detail below.

Conductive Support

The conductive support 30 is composed of a conductive material. Examples of the conductive material include metals and alloys such as aluminium, copper alloys, and stainless steel; iron plated with chromium, nickel, or the like; and conductive resins.

The conductive support 30 serves as an electrode and a support member of the charging roller. The conductive support 30 is composed of a metal such as iron (e.g., free-cutting steel), copper, brass, stainless steel, aluminium, or nickel.

The conductive support 30 is a conductive rod-like member. Examples of the conductive rod-like member include a conductive member prepared by plating the outer peripheral surface of a member composed of a resin, ceramic, or the like; and a conductive member prepared by dispersing a conductant agent in a member composed of a resin, ceramic, or the like.

The conductive support 30 may be a hollow member (i.e., tubular member) or a nonhollow member.

Conductive Elastic Layer

The conductive elastic layer 31 is an optional layer that may be disposed on the outer peripheral surface of the conductive support 30 as needed.

The conductive elastic layer 31 includes, for example, an elastic material, a conductant agent, and, as needed, other additives.

Examples of the elastic material include an isoprene rubber, a chloroprene rubber, an epichlorohydrin rubber, a butyl rubber, polyurethane, a silicone rubber, a fluorine rubber, a styrene-butadiene rubber, a butadiene rubber, a nitrile rubber, an ethylene propylene rubber, an epichlorohydrin-ethylene oxide copolymer rubber, an epichlorohydrin-ethylene oxide-allyl glycidyl ether copolymer rubber, an ethylene-propylene-diene terpolymer rubber (EPDM), an acrylonitrile-butadiene copolymer rubber (NBR), natural rubbers, and rubber blends thereof. In particular, polyurethane, a silicone rubber, an EPDM, an epichlorohydrin-ethylene oxide copolymer rubber, an epichlorohydrin-ethylene oxide-allyl glycidyl ether copolymer rubber, an NBR, and rubber blends thereof are desirably used. These elastic materials may be, but are not necessarily, foamed.

Examples of the conductant agent include an electron conductant agent and an ion conductant agent. Examples of the electron conductant agent include a powder of carbon black such as Ketjen black or acetylene black; powders of pyrolytic carbon and graphite; powders of various conductive metals and alloys such as aluminium, copper, nickel, and stainless steel; powders of various conductive metal oxides such as tin oxide, indium oxide, titanium oxide, a tin oxide-antimony oxide solid solution, and a tin oxide-indium oxide solid solution; and a powder of an insulating material the surfaces of particles of which have been treated to have conductivity. Examples of the ion conductant agent include perchlorates and chlorates of tetraethylammonium, lauryltrimethylammonium, and the like; and perchlorates and chlorates of alkali metals and alkaline-earth metals such as lithium and magnesium.

These conductant agents may be used alone or in combination of two or more.

Specific examples of the carbon black include "SPECIAL BLACK 350", "SPECIAL BLACK 100", "SPECIAL BLACK 250", "SPECIAL BLACK 5", "SPECIAL BLACK 4", "SPECIAL BLACK 4A", "SPECIAL BLACK 550", "SPECIAL BLACK 6", "COLOR BLACK FW200", "COLOR BLACK FW2", and "COLOR BLACK FW2V" produced by Orion Engineered Carbons; and "MONARCH1000", "MONARCH1300", "MONARCH1400", "MOGUL-L", and "REGAL400R" produced by Cabot Corporation.

These conductant agents desirably have an average particle diameter of 1 nm or more and 200 nm or less. The average particle diameter of a conductant agent is measured by observing a sample taken from the conductive elastic layer 31 with an electron microscope, measuring the diameters (maximum diameters) of 100 particles of the conductant agent, and taking the average thereof. The measurement of the average particle diameter may be carried out using, for example, "Zetasizer Nano ZS" produced by Sysmex Corporation.

The content of the conductant agent in the conductive elastic layer 31 is not particularly limited. In the case where the above electron conductant agents are used as a conductant agent, the content of the conductant agent in the conductive elastic layer 31 is desirably 1 part by weight or more and 30 parts by weight or less and is more desirably 15 parts by weight or more and 25 parts by weight or less relative to 100 parts by weight of the elastic material. In the case where the above ion conductant agents are used as a conductant agent, the content of the conductant agent in the conductive elastic layer 31 is desirably 0.1 part by weight or more and 5.0 parts by weight or less and is more desirably 0.5 parts by weight or more and 3.0 parts by weight or less relative to 100 parts by weight of the elastic material.

Examples of the other additives that may be added to the conductive elastic layer 31 include a softener, a plasticizer, a curing agent, a vulcanizing agent, a vulcanization accelerator, an antioxidant, a surfactant, a coupling agent, a filler (e.g., silica or calcium carbonate), and a blowing agent, which are commonly added to an elastic layer.

A method for and an order of mixing together the conductant agent, the elastic material, and the other components (i.e., various components such as a vulcanizing agent and a blowing agent added as needed), which constitute the conductive elastic layer 31, in order to form the conductive elastic layer 31 are not particularly limited. In general, for example, all the above components are mixed together using a tumbler, a V-blender, or the like, and the resulting mixture is melt-mixed and extruded into shape with an extruder. In another case, the mixture is formed into shape with a press-forming machine, and the shaped material is subsequently ground.

The thickness of the conductive elastic layer 31 is desirably set to about 1 mm or more and about 10 mm or less and is more desirably set to about 2 mm or more and 5 mm or less.

The volume resistivity of the conductive elastic layer 31 is desirably $10^3$ Ωcm or more and $10^{14}$ Ωcm or less.

Outermost Layer

The outermost layer 32 is the surface layer of the charging member according to this embodiment which is brought into contact with a body-to-be-charged such as an electrophotographic photosensitive member. The outermost layer of the charging member according to this embodiment includes porous silica and an N-alkoxymethylated polyamide and has a gel fraction of 50% or more and a surface roughness Rz of 2 μm or more and 20 μm or less.

As illustrated in FIG. 1, in the case where the conductive elastic layer 31 is disposed on the outer peripheral surface of the conductive support 30, the outermost layer 32 is formed on the outer peripheral surface of the conductive elastic layer 31 and serves as an outermost layer; and in the case where the conductive elastic layer 31 is not disposed on the outer peripheral surface of the conductive support 30, the outermost layer 32 may be formed on the outer peripheral surface of the conductive support 30 and serve as an outermost layer.

Porous Silica

The outermost layer of the charging member according to this embodiment includes porous silica. The term "porous" used herein means that a material such as a filler (e.g., silica particles) has pores in the surfaces of the particles of the material, the pores having a diameter equal to or less than ½ the diameter of the particles of the material and a depth of 0.001 μm or more. Whether a material is "porous" or not may be confirmed by observing a secondary electron image with an FE-SEM "JSM-6700F" produced by JEOL, Ltd. at an accelerating voltage of 5 kV. If the depth of the pores is 0.001 μm or less, the durability of the charging member may become degraded.

Adding the porous silica to the outermost layer may enhance the uniform-charging capability of the charging member as described above. Furthermore, a crosslinking reaction of the N-alkoxymethylated polyamide may be proceeded and, as a result, the N-alkoxymethylated polyamide becomes likely to be merged with the porous silica. This suppresses the progress of fracture of the outermost layer due to fatigue which may occur when the charging member is used for a long period of time and reduces the occurrence of cracking in the outermost layer. Reducing the occurrence of cracking in the outermost layer limits the occurrence of image defects, because image defects are caused by a toner, external additives included in the toner, and the like adhering to or being deposited on cracked portions of the outermost layer. The toner and the external additives result in the unevenness in the surface resistivity of the charging member and thereby destabilize the charging performance of the charging member. Thus, reducing the occurrence of cracking in the outermost layer enhances the uniform-charging capability and durability of the charging member. This enables the charging member to maintain the high uniform-charging capability over a longed period of time.

The porous silica may optionally be subjected to a surface treatment. Any surface treatment agent that enables predetermined properties to be achieved may be used and selected from the materials known in the related art. Examples of the surface treatment agent include silane coupling agents, titanate coupling agents, aluminium coupling agents, and surfactants. In particular, silane coupling agents are preferably used in order to achieve high adhesion to resin components. Silane coupling agents including an amino group are further preferably used.

Any silane coupling agent including an amino group which enables high adhesion to the N-alkoxymethylated polyamide to be achieved may be used. Specific examples of such a silane coupling agent including an amino group include, but are not limited to, 3-aminopropyltriethoxysilane, N-2-(aminoethyl)-3-aminopropyltrimethoxysilane, N-2-(aminoethyl)-3-aminopropylmethylmethoxysilane, and N,N-bis(2-hydroxyethyl)-3-aminopropyltriethoxysilane.

Two or more silane coupling agents may be used in combination. Examples of silane coupling agents that can be used in combination with the above silane coupling agents including an amino group include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

The surface treatment of the porous silica may be performed by any method known in the related art, such as a dry process or a wet process.

The average particle diameter of the porous silica is preferably 2 μm or more and 15 μm or less in order to, for example, control the surface roughness Rz of the outermost layer to be 2 μm or more and 20 μm or less. Limiting the average particle diameter of the porous silica to be within the above range enhances the capability of the charging member to maintain the uniform-charging capability. Therefore, the average particle diameter of the porous silica is more preferably 3 μm or more and 12 μm or less.

The average particle diameter of the porous silica is calculated by observing porous silica used for forming the outermost layer or a sample taken from the outermost layer 32 with an electron microscope, measuring the diameters (maximum diameters) of 100 porous silica particles, and taking the average thereof.

The porous silica may be commercially available porous silica such as SUNSPHERE Series produced by AGC Si-Tech. Co., Ltd.

The content of the porous silica in the outermost layer 32 is preferably 1% by weight or more and 50% by weight or less and is more preferably 3% by weight or more and 45% by weight or less from the viewpoint of uniform-charging capability.

N-Alkoxymethylated Polyamide

The outermost layer includes an N-alkoxymethylated polyamide as a resin component. Preferable examples of the N-alkoxymethylated polyamide include N-methoxymethylated polyamide and N-ethoxymethylated polyamide. The N-alkoxymethylated polyamide may be a commercially available N-alkoxymethylated polyamide such as N-methoxymethylated polyamide "Toresin" produced by Nagase ChemteX Corporation.

The content of the N-alkoxymethylated polyamide in the outermost layer 32 is preferably 20% by weight or more and 99% by weight or less and is more preferably 50% by weight or more and 95% by weight or less.

Second Resin Component

The outermost layer may further include a resin component other than the N-alkoxymethylated polyamide (hereinafter, referred to as "second resin component").

Examples of the resin other than the N-alkoxymethylated polyamide which may be added to the outermost layer include polyamide resins other than the N-alkoxymethylated polyamide, polyvinyl acetal resins, acrylic resins, polyester resins, phenolic resins, epoxy resins, melamine resins, and benzoguanamine resins.

A desirable example of the resin other than the N-alkoxymethylated polyamide which may be added to the outermost layer is a nylon copolymer which includes one or more polymerization units selected from nylon 610, nylon 11, and nylon 12. Examples of the other polymerization units included in this copolymer include nylon 6 and nylon 66. The nylon copolymer may be a commercially available nylon copolymer such as "Amilan CM8000" produced by Toray Industries, Inc. The above-described elastic materials that may be added to the conductive elastic layer 31 may also be used as a resin other than the N-alkoxymethylated polyamide.

Examples of the polyamide resin other than the N-alkoxymethylated polyamide include the polyamide resins described in "Polyamide Resin Handbook", Osamu Fukumoto, 8400, Nikkan Kogyo Shimbun, Ltd. In particular, alcohol-soluble polyamide resins are desirably used.

Examples of the polyvinyl acetal resins include polyvinyl butyral resins, polyvinyl formal resins, and partially acetalised polyvinyl butyral resins in which some of the butyral groups are modified with formal, acetoacetal, or the like.

The polyester resins are polyester resins including an acid-derived component and an alcohol-derived component. The polyester resins may optionally include other components as needed.

A polyester resin is produced by synthesizing an acid (e.g., dicarboxylic acid) component with an alcohol (e.g., diol) component. The term "acid-derived component" used herein refers to a structural unit of a polyester resin which served as an acid component prior to the synthesis of the polyester resin. The term "alcohol-derived component" used herein refers to a structural unit of a polyester resin which served as an alcohol component prior to the synthesis of the polyester resin.

In other words, the polyester resins that may be used as a resin other than the N-alkoxymethylated polyamide are polyester resins produced by, for example, synthesizing the acid-derived component with the alcohol-derived component by an ordinary method.

The phenolic resins are desirably monomers of monomethylol phenols, dimethylol phenols, and trimethylol phenols prepared by reacting a compound including a phenolic structure, for example, substituted phenols including one hydroxyl group, such as phenol, cresol, xylenol, paraalkylphenols, and paraphenylphenols; substituted phenols including two hydroxyl groups, such as catechol, resorcinol, and hydroquinone; bisphenols such as bisphenol A and bisphenol Z; and biphenols) with formaldehyde, paraformaldehyde, or the like in the presence of an acid or alkali catalyst. Mixtures of these monomers, oligomers of these monomers, and mixtures of these monomers and oligomers may also be desirably used.

The term "epoxy resins" used herein refers to all the monomers, oligomers, and polymers that include two or more epoxy groups per molecule, and the molecular weights and molecular structures of the epoxy resins are not particularly limited. Examples of such epoxy resins include biphenyl-based epoxy resins, bisphenol-based epoxy resins, stilbene-based epoxy resins, phenol-novolac-based epoxy resins, cresol-novolac-based epoxy resins, triphenolmethane-based epoxy resins, alkyl-modified-triphenolmethane-based epoxy resins, triazine-nucleus-containing epoxy resins, dicyclopentadiene-modified-phenol-based epoxy resins, and phenol-aralkyl-based epoxy resins (which include a phenylene skeleton, a diphenylene skeleton, or the like). These epoxy resins may be used alone or in combination of two or more.

Among these epoxy resins, biphenyl-based epoxy resins, bisphenol-based epoxy resins, stilbene-based epoxy resins, phenol-novolac-based epoxy resins, cresol-novolac-based epoxy resins, and triphenolmethane-based epoxy resins are desirably used, biphenyl-based epoxy resins, bisphenol-based epoxy resins, phenol-novolac-based epoxy resins, and cresol-novolac-based epoxy resins are further desirably used, and bisphenol-based epoxy resins are particularly desirably used.

The melamine resins and benzoguanamine resins may be various compounds known in the related art which include a melamine structure and a guanamine structure, respectively. Examples of the melamine resins and benzoguanamine resins include the compounds represented by General Formulae (A) and (B) below. The compounds represented by General Formulae (A) and (B) are produced by synthesizing guanamine or melamine with formaldehyde by a method known in the related art (e.g., Jikken Kagaku Kouza 4th Edition, Vol. 28, p. 430). These melamine resins and benzoguanamine resins may be used alone or in combination of two or more. These melamine resins and benzoguanamine resins are more desirably used in combination of two or more or in the form of an oligomer in order to enhance solubility.

(A)

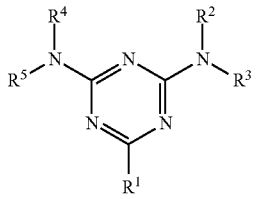

In General Formula (A), $R^1$ represents a linear or branched alkyl group having 1 to 10 carbon atoms, a substituted or unsubstituted phenyl group having 6 to 10 carbon atoms, or a substituted or unsubstituted alicyclic hydrocarbon group having 4 to 10 carbon atoms; and $R^2$ to $R^5$ each independently represent a hydrogen atom, a —$CH_2$—OH group, or a —$CH_2$—O—$R^6$ group, where $R^6$ is a linear or branched alkyl group having 1 to 10 carbon atoms.

(B)

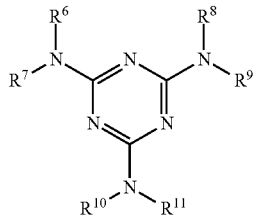

In General Formula (B), $R^6$ to $R^{11}$ each independently represent a hydrogen atom, a —$CH_2$—OH group, a —$CH_2$—O—$R^{12}$ group, or a —O—$R^{12}$ group, where $R^{12}$ is a linear or branched alkyl group having 1 to 5 carbon atoms, such as a methyl group, an ethyl group, or a butyl group.

The compound represented by General Formula (B) may be produced by, for example, synthesizing melamine with formaldehyde by a method known in the related art (e.g., as in the synthesis of the melamine resin described in Jikken Kagaku Kouza 4th Edition, Vol. 28, p. 430).

The guanamine resins and melamine resins may be commercially available resins. Examples of commercially available guanamine resins include SUPER BECKAMINE (R) L-148-55, SUPER BECKAMINE (R) 13-535, SUPER BECKAMINE (R) L-145-60, and SUPER BECKAMINE (R) TD-126 produced by DIC Corporation; and NIKALAC BL-60 and NIKALAC BX-4000 produced by Nippon Carbide Industries Co., Inc. Examples of commercially available melamine resins include Super Melami No. 90 produced by NOF Corporation, SUPER BECKAMINE (R) TD-139-60 produced by DIC Corporation, U-VAN 2020 produced by Mitsui Chemicals, Inc., Sumitex Resin M-3 produced by Sumitomo Chemical Co., Ltd., and NIKALAC MW-30 produced by Nippon Carbide Industries Co., Inc. The above commercially available guanamine resins and melamine resins may be used directly.

The proportion (i.e., weight proportion) of the amount of N-alkoxymethylated polyamide to the total amount of resin components contained in the outermost layer is preferably 20% by weight or more and is more preferably 50% by weight or more.

Other Components

Examples of other components that may be added to the outermost layer include a conductivity-imparting agent (i.e., conductant agent), a softener, a plasticizer, a curing agent, a vulcanizing agent, a vulcanization accelerator, an antioxidant, a surfactant, and a coupling agent, which are commonly added to a surface layer of a charging member.

The outermost layer preferably includes a conductivity-imparting agent. An outermost layer including a conductivity-imparting agent enables the charging member to charge a body-to-be-charged more uniformly.

Examples of the conductivity-imparting agent include the above-described electron conductant agents and ion conductant agents that may be added to the conductive elastic layer. Among those electron conductant agents and ion conductant agents, at least one ion conductant agent or electron conductant agent, such as carbon black, is preferably used from the viewpoint of unevenness in resistivity.

The conductivity-imparting agent may be used alone, or two or more conductivity-imparting agents may be used in combination.

The content of the conductivity-imparting agent in the outermost layer is not particularly limited. In the case where the above-described electron conductant agents are used, the content of the conductivity-imparting agent in the outermost layer is preferably 1 part by weight or more and 50 parts by weight or less and is more preferably 3 parts by weight or more and 30 parts by weight or less relative to 100 parts by weight of the N-alkoxymethylated polyamide included in the outermost layer.

In the case where the above-described ion conductant agents are used, the content of the conductivity-imparting agent in the outermost layer is preferably 1 part by weight or more and 50 parts by weight or less and is more preferably 3 parts by weight or more and 30 parts by weight or less relative to 100 parts by weight of the N-alkoxymethylated polyamide included in the outermost layer.

The outermost layer is formed by coating the surface of the conductive elastic layer or the like with a curable resin composition (i.e., outermost-layer forming coating liquid) containing the N-alkoxymethylated polyamide, porous silica, and, as needed, other additives such as the second resin component and the conductivity-imparting agent and subsequently, for example, drying the coating film deposited on the surface of the conductive elastic layer or the like by heating. A crosslinking reaction occurs in the outermost layer due to heating or the like.

The outermost layer is preferably a resin layer in which crosslinks are formed by using a catalyst in order to promote curing (i.e., crosslinking) that occurs during heat drying. An example of the catalyst is an acid catalyst.

Examples of the acid catalyst include aliphatic carboxylic acids such as acetic acid, chloroacetic acid, trichloroacetic acid, trifluoroacetic acid, oxalic acid, maleic acid, malonic acid, lactic acid, and citric acid; aromatic carboxylic acids such as benzoic acid, phthalic acid, terephthalic acid, and trimellitic acid; aliphatic and aromatic sulfonic acids such as methanesulfonic acid, dodecylsulfonic acid, benzenesulfonic acid, dodecylbenzenesulfonic acid, naphthalenesulfonic acid, para-toluenesulfonic acid, dinonylnaphthalenesulfonic acid (DNNSA), dinonylnaphthalenedisulfonic acid (DNNDSA), and phenolsulfonic acid; and phosphoric acid. Para-toluenesulfonic acid, dodecylbenzenesulfonic acid, and phosphoric acid are preferably used from the viewpoints of catalytic activity and ease of forming a film.

Using an acid catalyst the ability of which can be increased when being heated at a temperature equal to or higher than a certain temperature, that is, "thermal latent catalyst", lowers the curing temperature of a curable resin composition and enhances the preservation stability (e.g., dispersion stability) of the curable resin composition because the ability of the thermal latent catalyst is low at a temperature at which the liquid of the curable resin composition is stored but becomes high when the curable resin composition is cured.

Examples of the thermal latent catalyst include microcapsules prepared by encapsulating an organic sulfone compound or the like with a polymer in the form of particles; porous compounds such as zeolite on which an acid or the like is adsorbed; thermal latent proton acid catalysts prepared by blocking at least one proton acid or proton-acid derivative with a base; thermal latent catalysts prepared by esterifying at least one proton acid or proton-acid derivative with a primary or secondary alcohol; thermal latent catalysts prepared by blocking at least one proton acid or proton-acid derivative with at least one vinyl ether or vinyl thioether; a boron trifluoride monoethylamine complex; and a boron trifluoride pyridine complex.

Among these thermal latent catalysts, thermal latent proton acid catalysts prepared by blocking at least one proton acid or proton-acid derivative with a base are preferably used from the viewpoints of catalytic ability, preservation stability, availability, and the cost.

Examples of the proton acid of the thermal latent proton acid catalyst include sulfuric acid, hydrochloric acid, acetic acid, formic acid, nitric acid, phosphoric acid, sulfonic acid, monocarboxylic acid, polycarboxylic acids, propionic acid, oxalic acid, benzoic acid, acrylic acid, methacrylic acid, itaconic acid, phthalic acid, maleic acid, benzenesulfonic acid, o-toluenesulfonic acid, m-toluenesulfonic acid, p-toluenesulfonic acid, styrenesulfonic acid, dinonylnaphthalenesulfonic acid, dinonylnaphthalenedisulfonic acid, decylbenzenesulfonic acid, undecylbenzenesulfonic acid, tridecylbenzenesulfonic acid, tetradecylbenzenesulfonic acid, and dodecylbenzenesulfonic acid. Examples of the proton-acid derivative include substances (e.g., alkali metal salts and alkaline-earth metal salts) prepared by neutralizing proton acids such as sulfonic acid and phosphoric acid; and high-molecular compounds (e.g., polyvinylsulfonic acid) having a polymer chain including a proton-acid skeleton. Examples of the base with which the proton acid is blocked include amines.

The types of the amines are not particularly limited. Primary amines, secondary amines, and tertiary amines may be used.

Examples of the primary amines include methylamine, ethylamine, propylamine, isopropylamine, n-butylamine, isobutylamine, t-butylamine, hexylamine, 2-ethylhexylamine, 2-ethylhexylamine, sec-butylamine, allylamine, and methylhexylamine.

Examples of the secondary amines include dimethylamine, diethylamine, di-n-propylamine, diisopropylamine, di-n-butylamine, diisobutylamine, di-t-butylamine, dihexylamine, di(2-ethylhexyl)amine, N-isopropyl-N-isobutylamine, di(2-ethylhexyl)amine, di-sec-butylamine, diallylamine, N-methylhexylamine, 3-pipecoline, 4-pipecoline, 2,4-lupetidine, 2,6-lupetidine, 3,5-lupetidine, morpholine, and N-methylbenzylamine.

Examples of the tertiary amines include trimethylamine, triethylamine, tri-n-propylamine, triisopropylamine, tri-n-butylamine, triisobutylamine, tri-t-butylamine, trihexylamine, tri(2-ethylhexyl)amine, N-methylmorpholine, N,N-dimethylallylamine, N-methyldiallylamine, triallylamine, N,N-dimethylallylamine, N,N,N',N'-tetramethyl-1,2-diaminoethane, N,N,N',N'-tetramethyl-1,3-diaminopropane, N,N,N',N'-tetraallyl-1,4-diaminobutane, N-methylpiperidine, pyridine, 4-ethylpyridine, N-propyldiallylamine, 3-dimethylaminopropanol, 2-ethylpyrazine, 2,3-dimethylpyrazine, 2,5-dimethylpyrazine, 2,4-lutidine, 2,5-lutidine, 3,4-lutidine, 3,5-lutidine, 2,4,6-collidine, 2-methyl-4-ethylpyridine, 2-methyl-5-ethylpyridine, N,N,N',N'-tetramethylhexamethylenediamine, N-ethyl-3-hydroxypiperidine, 3-methyl-4-ethylpyridine, 3-ethyl-4-methylpyridine, 4-(5-nonyl)pyridine, imidazole, and N-methylpiperazine.

The thermal latent catalysts may be commercially available thermal latent catalysts. Examples of commercially available thermal latent catalysts include "NACURE 2501" (toluenesulfonic acid dissociation, methanol/isopropanol solvent, pH: 6.0 or more and 7.2 or less, dissociation temperature: 80° C.), "NACURE 2107" (p-toluenesulfonic acid dissociation, isopropanol solvent, pH: 8.0 or more and 9.0 or less, dissociation temperature: 90° C.), "NACURE 2500" (p-toluenesulfonic acid dissociation, isopropanol solvent, pH: 6.0 or more and 7.0 or less, dissociation temperature: 65° C.), "NACURE 2530" (p-toluenesulfonic acid dissociation, methanol/isopropanol solvent, pH: 5.7 or more and 6.5 or less, dissociation temperature: 65° C.), "NACURE 2547" (p-toluenesulfonic acid dissociation, aqueous solution, pH: 8.0 or more and 9.0 or less, dissociation temperature: 107° C.), "NACURE 2558" (p-toluenesulfonic acid dissociation, ethylene/glycol solvent, pH: 3.5 or more and 4.5 or less, dissociation temperature: 80° C.), "NACURE XP-357" (p-toluenesulfonic acid dissociation, methanol solvent, pH: 2.0 or more and 4.0 or less, dissociation temperature: 65° C.), "NACURE XP-386" (p-toluenesulfonic acid dissociation, aqueous solution, pH: 6.1 or more and 6.4 or less, dissociation temperature: 80° C.), "NACURE XC-2211" (p-toluenesulfonic acid dissociation, pH: 7.2 or more and 8.5 or less, dissociation temperature: 80° C.), "NACURE 5225" (dodecylbenzenesulfonic acid dissociation, isopropanol solvent, pH: 6.0 or more and 7.0 or less, dissociation temperature: 120° C.), "NACURE 5414" (dodecylbenzenesulfonic acid dissociation, xylene solvent, dissociation temperature: 120° C.), "NACURE 5528" (dodecylbenzenesulfonic acid dissociation, isopropanol solvent, pH: 7.0 or more and 8.0 or less, dissociation temperature: 120° C.), "NACURE 5925" (dodecylbenzenesulfonic acid dissociation, pH: 7.0 or more and 7.5 or less, dissociation temperature: 130° C.), "NACURE 1323" (dinonylnaphthalenesulfonic acid dissociation, xylene solvent, pH: 6.8 or more and 7.5 or less, dissociation temperature: 150° C.), "NACURE 1419" (dinonylnaphthalenesulfonic acid dissociation, xylene/methyl isobutyl ketone solvent, dissociation temperature: 150° C.), "NACURE 1557" (dinonylnaphthalenesulfonic acid dissociation, butanol/2-butoxyethanol solvent, pH: 6.5 or more and 7.5 or less, dissociation temperature: 150° C.), "NACURE X49-110" (dinonylnaphthalenedisulfonic acid dissociation, isobutanol/isopropanol solvent, pH: 6.5 or more and 7.5 or less, dissociation temperature: 90° C.), "NACURE 3525" (dinonylnaphthalenedisulfonic acid dissociation, isobutanol/isopropanol solvent, pH: 7.0 or more and 8.5 or less, dissociation temperature: 120° C.), "NACURE XP-383" (dinonylnaphthalenedisulfonic acid dissociation, xylene solvent, dissociation temperature: 120° C.), "NACURE 3327" (dinonylnaphthalenedisulfonic acid dissociation, isobutanol/isopropanol solvent, pH: 6.5 or more and 7.5 or less, dissociation temperature: 150° C.), "NACURE 4167" (phosphoric acid dissociation, isopropanol/isobutanol solvent, pH: 6.8 or more and 7.3 or less, dissociation temperature: 80° C.), "NACURE XP-297" (phosphoric acid dissociation, water/isopropanol solvent, pH: 6.5 or more and 7.5 or less, dissociation temperature: 90° C., and "NACURE 4575" (phosphoric acid dissociation, pH: 7.0 or more and 8.0 or less, dissociation temperature: 110° C.) produced by King Industries, Inc.

These thermal latent catalysts may be used alone or in combination of two or more.

The proportion of the amount of thermal latent catalyst used to the total amount of solid components of the curable resin composition is preferably 0.01% by weight or more and 20% by weight or less and is more preferably 0.1% by weight or more and 10% by weight or less. Setting the proportion of the amount of thermal latent catalyst to 0.01% by weight or more increases the catalytic activity of the thermal latent catalyst. Setting the proportion of the amount of thermal latent catalyst to 20% by weight or less reduces the likelihood of the thermal latent catalyst being precipitated as foreign matter after a heat treatment has been performed.

Gel Fraction

The gel fraction of the outermost layer is 50% or more, is preferably 60% or more, and is more preferably 90% or more. Setting the gel fraction of the outermost layer to 50% or more enhances the mechanical properties of the outermost layer, which reduces the likelihood of the outermost layer fracturing due to fatigue when the charging member is used for a long period of time. This enhances the durability of the charging member and enables the charging member to maintain the uniform-charging capability over a long period of time. However, if the gel fraction of the outermost layer is less than 50%, the outermost layer may fracture due to fatigue when the charging member is used for a long period of time.

The gel fraction of the outermost layer may be controlled by, for example, changing the temperature at which heating is performed or the amount of time for which heating is performed in the formation of the outermost layer and thereby changing the amount of crosslinks formed.

In the outermost layer, the main component of the outermost layer, that is, the N-alkoxymethylated polyamide, is considered to form crosslinks. The N-alkoxymethylated polyamide is also considered to form crosslinks with at least one component selected from the second resin component and porous silica in the case where the outermost layer includes a resin component (i.e., second resin component) other than the N-alkoxymethylated polyamide.

The gel fraction of the outermost layer is measured in accordance with JIS K6796 (1998). Specifically, the weight of a piece taken from the outermost layer of the charging member is measured, which is considered to be the weight of a resin before being extracted with a solvent. The piece of the outermost layer is subsequently immersed in a solvent such as methanol or acetone for 24 hours. After the resulting bottoms are separated by filtering, the solvent is removed and the bottoms are dried. Then, the weight of the bottoms is measured, which is considered to be the weight of the resin after being extracted. The gel fraction is calculated using the following expression.

Gel Fraction (%)=((Weight of Resin After Solvent Extraction)/(Weight of Resin After Solvent Extraction))×100

When the gel fraction, that is, the degree of crosslinking, in the outermost layer is 50% or more, the outermost layer serves as a coating film having a considerably developed crosslink structure, which has high cracking resistance.

Surface Roughness Rz

The surface roughness (i.e., ten-point average roughness) Rz of the outermost layer is 2 μm or more and 20 μm or less, is preferably 2 μm or more and 18 μm or less, and is more preferably 2 μm or more and 15 μm or less.

Setting the surface roughness Rz of the outermost layer to 2 μm or more and 20 μm or less reduces inconsistency in the charging characteristics of the charging member. Furthermore, the likelihood of foreign matter such as a toner or an external additive adhering to the outermost layer 32 may be reduced, which enhances the resistance to contamination of the charging member and the durability of the charging member. This enables the charging member to have the uniform-charging capability over a long period of time. If the surface roughness Rz of the outermost layer is less than 2 μm, the effect of reducing the likelihood of the charging member being contaminated by a toner, an external additive included in the toner, or the like may be reduced. If the surface roughness Rz of the outermost layer exceeds 20 μm, a toner, paper dusts, and the like are likely to accumulate and remain at the uneven spots. Moreover, abnormal discharge is likely to occur locally, which may cause image defects such as white dots to occur. In addition, cracking is likely to occur in the surface of the charging member when the charging member is used for a long period of time.

The surface roughness Rz of the outermost layer may be controlled by changing, for example, the diameter of porous silica particles, the amount of porous silica added, or the thickness of the outermost layer.

The surface roughness Rz of the outermost layer is measured in accordance with JIS B0601 (1994). Specifically, the surface roughness of the outermost layer is measured over a length of 2.5 mm using a contact surface-roughness measuring device "SURFCOM 570A" produced by Tokyo Seimitsu Co., Ltd. is used at 23° C. and 55 RH % with a stylus having a diamond tip (5 μmR, 90° cone). The measurement is made three times at different positions, and the average thereof is considered to be the surface roughness Rz of the outermost layer.

Thickness

The thickness of the outermost layer 32 is desirably large in order to increase the abrasion resistance of the charging member 121. However, an excessively large thickness of the outermost layer may deteriorate the capability of the charging member to charge a body-to-be-charged. Thus, the thickness of the outermost layer 32 is selected to be within the range of 0.01 μm or more and 1000 μm or less and is desirably set to be, for example, 2 μm or more and 25 μm or less.

Volume Resistivity

The volume resistivity of the outermost layer 32 is desirably $10^3$ Ωcm or more and $10^{14}$ Ωcm or less in order to enable the charging member to charge a body-to-be-charged by bringing the outermost layer into contact with the body-to-be-charged.

Method for Forming Outermost Layer

The outermost layer 32 is formed by, for example, coating the support 30 (i.e., outer peripheral surface of the conductive elastic layer 31) with a coating liquid prepared by dissolving or dispersing the above-described components in a solvent by immersion, spraying, vacuum evaporation deposition, plasma coating, or the like and subsequently drying the coating film.

The concentration of solid components in the outermost-layer forming coating liquid is desirably 5% by weight or more and 50% by weight or less in order to reduce fluctuations in the thickness of the outermost layer 32 and unevenness of the components dispersed in the outermost layer 32.

The drying conditions may be set depending on the types and amounts of resin and catalyst used. The drying temperature is desirably set to 40° C. or more and 200° C. or less and is more desirably set to 50° C. or more and 180° C. or less.

The drying time is desirably set to 5 minutes or more and 5 hours or less and is more desirably set to 10 minutes or more and 3 hours or less.

Drying may be performed by, for example, using hot air.

Charging Device

A charging device according to an embodiment is described below.

The charging device according to this embodiment includes the charging member according to the above-described embodiment.

Figure 3:
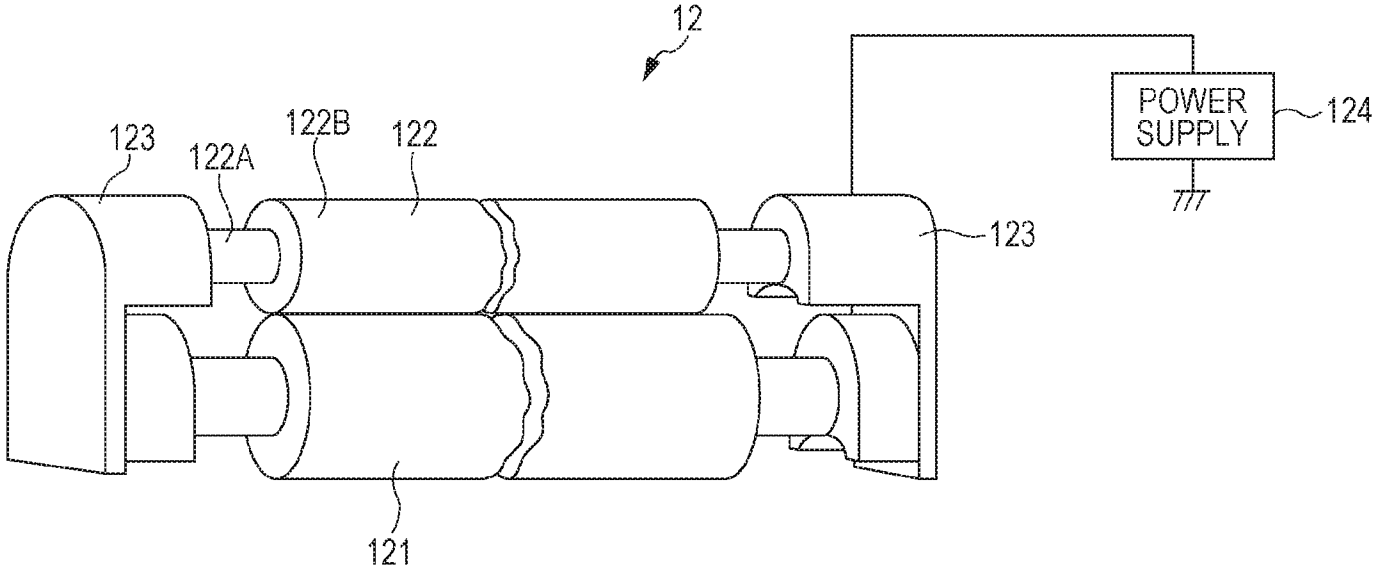
FIG. 3 is a schematic perspective view of an example of a charging device according to an embodiment.

FIG. 3 is a schematic perspective view of an example of the charging device according to this embodiment. A charging device 12 according to this embodiment includes, for example, a charging member 121 and a cleaning member 122 that are brought into contact with each other so as to be dented a certain amount as illustrated in FIG. 3. The respective ends of the support 30 of the charging member 121 and the respective ends of the support 122A of the cleaning member 122 in the axis direction are rotatably held by a pair of conductive bearings 123. One of the conductive bearings 123 is connected to a power supply 124.

The structure of the charging device according to this embodiment is not limited to the above-described one. For example, the cleaning member 122 may be omitted.

The cleaning member 122 is used for cleaning the surface of the charging member 121 and has a roller-like shape or the like. The cleaning member 122 includes, for example, a hollow or solid cylindrical support 122A and an elastic layer 122B disposed on the outer peripheral surface of the support 122A.

The support 122A is a conductive rod-like member composed of a metal such as iron (e.g., free-cutting steel), copper, brass, stainless steel, aluminium, or nickel. The support 122A may be prepared by, for example, plating the outer peripheral surface of a member composed of a resin, ceramic, or the like or dispersing a conductant agent in a member composed of a resin, ceramic, or the like. The support 122A may be a hollow member (i.e., tubular member) or a nonhollow member.

The elastic layer 122B may be composed of a foam having a three-dimensional porous structure including cavities and irregularities (hereinafter, referred to as "cells") in the inside and the surface thereof and may have elasticity. The elastic layer 122B includes a foamable resin material or rubber material, such as polyurethane, polyethylene, polyamide, an olefin, melamine, polypropylene, an acrylonitrile-butadiene copolymer rubber (NBR), an ethylene-propylene-diene copolymer rubber (EPDM), a natural rubber, a styrene-butadiene rubber, chloroprene, silicone, or nitrile.

Among these foamable resin materials and rubber materials, polyurethane, which has high tearing and tensile strengths, is particularly preferably used in order to enable foreign matter such as a toner and an external additive to be efficiently removed with the cleaning member 122 being rotated by and rubbing the charging member 121, to reduce the likelihood of the surface of the charging member 121 being scratched by the cleaning member 122 rubbing against the charging member 121, and to reduce the occurrence of breakage and fracture over a long period of time.

The type of polyurethane is not particularly limited, and examples thereof include polyurethanes produced by reacting a polyol (e.g., polyester polyol, polyether polyol, or acrylic polyol) with an isocyanate (e.g., 2,4-tolylene diisocyanate, 2,6-tolylene diisocyanate, 4,4-diphenylmethane diisocyanate, tolidine diisocyanate, or 1,6-hexamethylene diisocyanate). Polyurethanes produced by reacting the above polyol with the above isocyanate in the presence of a chain extender (e.g., 1,4-butanediol or trimethylolpropane) may also be used. In general, polyurethane is foamed using a blowing agent such as water or an azo compound (e.g., azodicarbonamide or azobisisobutyronitrile).

The number of cells in the elastic layer 122B is desirably 20/25 mm or more and 80/25 mm or less, is further desirably 30/25 mm or more and 80/25 mm or less, and is particularly desirably 30/25 mm or more and 50/25 mm or less.

The hardness of the elastic layer 122B is desirably 100 N or more and 500 N or less, is further desirably 100 N or more and 400 N or less, and is particularly desirably 150 N or more and 400 N or less.

The conductive bearings 123 integrally hold the charging member 121 and the cleaning member 122 such that these members are rotatable and a certain distance between the axes of these members is maintained. The conductive bearings 123 may be composed of any conductive material, and the form of the conductive bearings 123 is not limited. Conductive bearings, conductive sliding bearings, and the like may be used.

The power supply 124 applies a voltage to one of the conductive bearings 123 and thereby charges the charging member 121 and the cleaning member 122 to the same polarity. The power supply 124 may be any high-voltage power supply known in the related art.

In the charging device 12 according to this embodiment, the charging member 121 and the cleaning member 122 are charged to the same polarity by, for example, applying a voltage to the conductive bearing 123 by using the power supply 124. This reduces the likelihood of foreign matter (e.g., toner or external additives) that may adhere onto the surface of the image holding member accumulating at the surfaces of the cleaning member 122 and the charging member 121 and enables the foreign matter to be transferred onto the image holding member and subsequently collected by a cleaning device of the image holding member. As a result, accumulation of contaminants at the charging member 121 and the cleaning member 122 may be reduced over a long period of time, which enables the charging performance of the charging member to be maintained.

Image Forming Apparatus and Process Cartridge

An image forming apparatus according to an embodiment includes an image holding member; a charging unit including the charging member according to the above-described embodiment, the charging unit charging the surface of the image holding member with the charging member being brought into contact with the surface of the image holding member; a latent-image forming unit that forms a latent image on the charged surface of the image holding member; a developing unit that develops the latent image formed on the surface of the image holding member with a toner in order to form a toner image; and a transfer unit that transfers the toner image formed on the surface of the image holding member to a recording medium.

The process cartridge according to this embodiment is detachably attachable to the above-described image forming apparatus and includes an image holding member and a charging unit including the charging member according to the above-described embodiment, the charging unit charging the surface of the image holding member with the charging member being brought into contact with the surface of the image holding member. The process cartridge according to this embodiment may optionally include at least one unit selected from the group consisting of a developing unit that develops a latent image formed on the surface of the image holding member with a toner to form a toner image, a transfer unit that transfers the toner image formed on the surface of the image holding member to a recording medium, and a cleaning unit that removes a toner that remains on the surface of the image holding member from which the toner image has been transferred.

Figure 4:
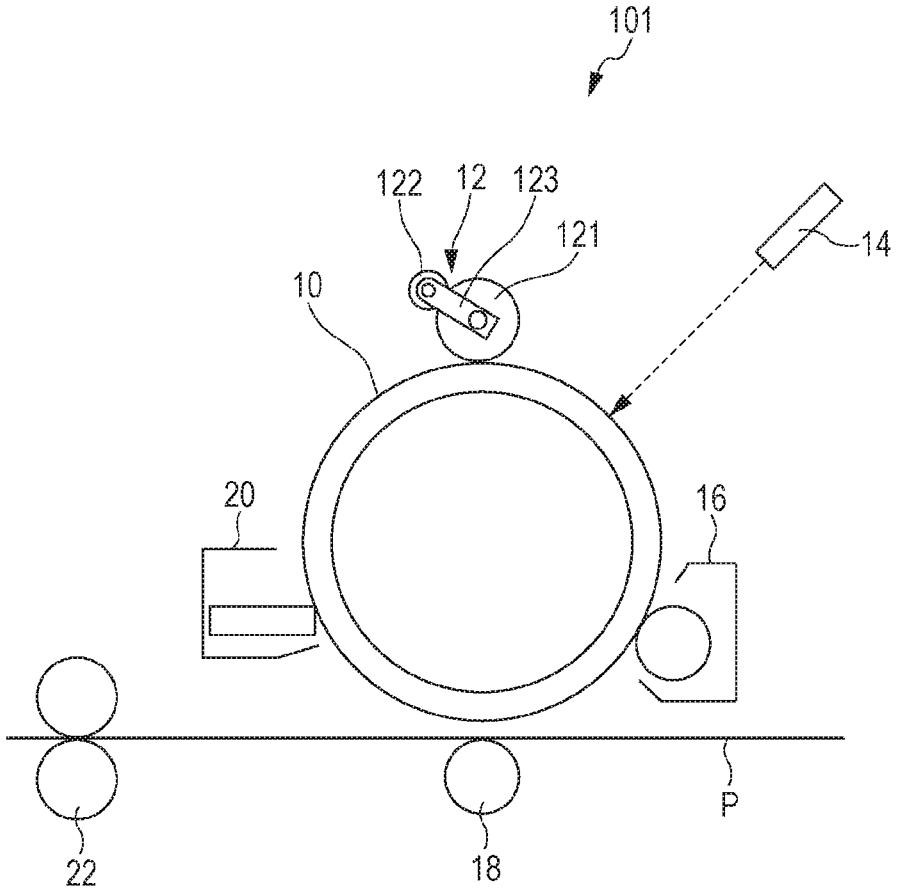
FIG. 4 schematically illustrates an example of an image forming apparatus according to an embodiment.
Figure 5:
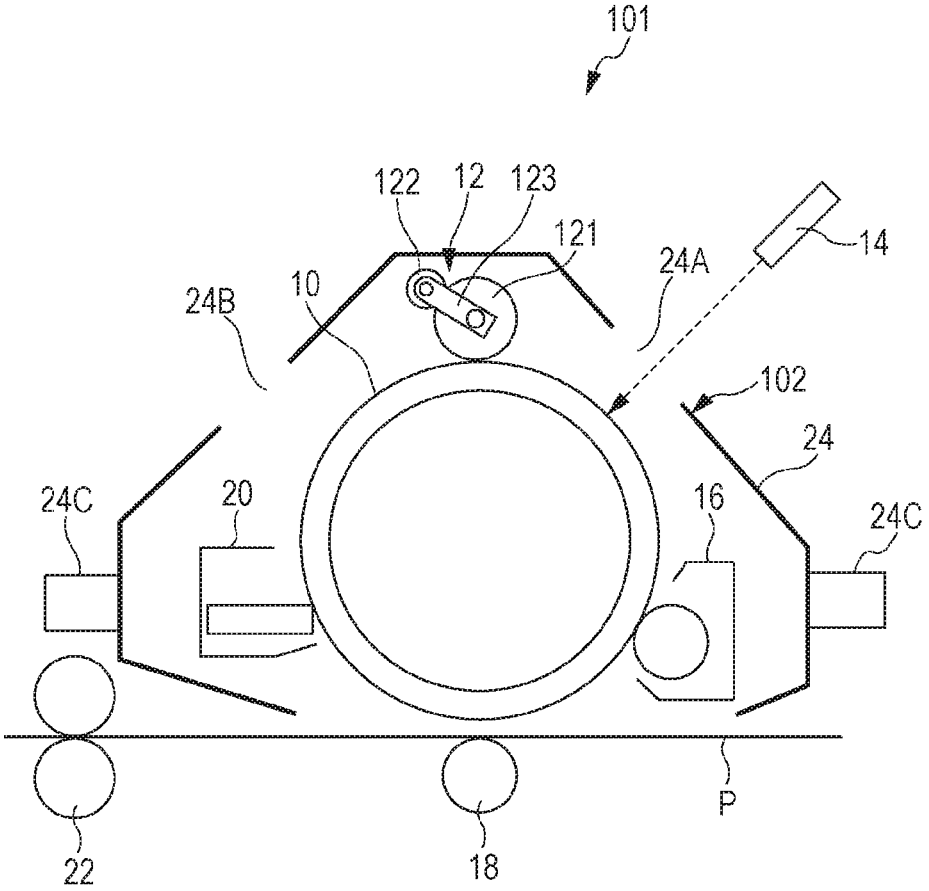
FIG. 5 schematically illustrates an example of a process cartridge according to an embodiment.

The image forming apparatus and the process cartridge according to this embodiment are described below with reference to the attached drawings. FIG. 4 schematically illustrates an example of the image forming apparatus according to this embodiment. FIG. 5 schematically illustrates an example of the process cartridge according to this embodiment.

An image forming apparatus 101 according to this embodiment includes an image holding member 10; and a charging device 12 that charges the image holding member, an exposure device 14 that exposes the image holding member 10 that has been charged by the charging device 12 to light in order to form a latent image, a developing device 16 that develops the latent image formed by the exposure device 14 with a toner in order to form a toner image, a transfer device 18 that transfers the toner image formed by the developing device 16 to a recording medium P, and a cleaning device 20 that removes a toner that remains on the surface of the image holding member 10 from which the toner image has been transferred, which are arranged in the vicinity of the image holding member 10 as illustrated in FIG. 4. The image forming apparatus 101 further includes a fixing device 22 that fixes the transferred toner image to the recording medium P by the transfer device 18.

The charging device 12 included in the image forming apparatus 101 according to this embodiment is the charging device according to the above-described embodiment that includes, for example, a charging member 121, a cleaning member 122 arranged to be brought into contact with the charging member 121, a pair of conductive bearings 123 with which the respective ends of the charging member 121 and the respective ends of the cleaning member 122 in the axis direction are rotatably held, and a power supply 124 connected to one of the conductive bearings 123.

The components of the image forming apparatus 101 according to this embodiment which are other than the charging device 12 (i.e., charging member 121) may be components of an electrophotographic image forming apparatus known in the related art. An example of each component is described below.

The type of the image holding member 10 is not particularly limited, and any photosensitive member known in the related art may be used. However, "separated-function" organic photosensitive members, which include a charge generating layer and a charge transporting layer separately, are preferably used. The image holding member 10 suitably include a protection layer having an electron-transportation capability and a crosslinked structure, the protection layer covering the surface layer of the image holding member 10. Photosensitive members including a siloxane resin, a phenolic resin, a melamine resin, a guanamine resin, or an acrylic resin that serves as a crosslinking component of the protection layer are also preferably used.

The exposure device 14 may be, for example, a laser optical system or an LED array.

The developing device 16 is, for example, a developing device that causes a toner to adhere to a latent image formed on the surface of the image holding member 10 with a developer-holding member including a developer layer formed on the surface thereof being brought into contact with or adjacent to the image holding member 10 in order to form a toner image. When the latent image is developed by the developing device 16, a developing method in which a two-component developer is used, which is known in the related art, is preferably employed. Examples of the developing method in which a two-component developer is used include a cascade method and a magnetic brush method.

The transfer device 18 may employ either a noncontact transferring method such as a corotron or a contact transferring method, in which a toner image is transferred to a recording medium P by bringing a conductive transfer roller into contact with the image holding member 10 with the recording medium P interposed therebetween.

The cleaning device 20 is a member that removes a toner, paper dust, and dust that adhere onto the surface of the image holding member 10 with, for example, a cleaning blade being brought into direct contact with the surface of the image holding member 10. Examples of the cleaning device 20 other than a cleaning blade include a cleaning brush and a cleaning roller.

The fixing device 22 is preferably a heat fixing device including a heating roller. The heat fixing device includes, for example, a fixing roller and a pressure roller or a pressure belt arranged to come into pressure contact with the fixing roller at a predetermined contact pressure. The fixing roller includes a hollow cylindrical core bar; a heater lamp for heating which is disposed in the core bar; and a "release layer" that is a heat-resistant resin coating layer or a heat-resistant rubber coating layer disposed on the outer peripheral surface of the core bar. The pressure roller includes a hollow cylindrical core bar and a heat-resistant elastic body layer disposed on the outer peripheral surface of the core bar. The pressure belt includes a belt-like support and a heat-resistant elastic body layer disposed on the surface of the support. An unfixed toner image is fixed by, for example, inserting a recording medium P on which an unfixed toner image has been deposited into a clearance between the fixing roller and the pressure roller or between the fixing roller and the pressure belt and subsequently melting a binder resin included in the toner, additives, and the like by heating.

The structure of the image forming apparatus 101 according to this embodiment is not limited to the above-described one. For example, the image forming apparatus according to this embodiment may be an intermediate transfer image forming apparatus including an intermediate transfer body or a "tandem" image forming apparatus including plural image forming units arranged in parallel which form toner images in different colors.

As illustrated in FIG. 5, the process cartridge according to this embodiment is a process cartridge 102 that integrally holds the image holding member 10, the charging device 12 that charges the surface of the image holding member 10 with the charging member 121 being brought into contact with the surface of the image holding member 10, the developing device 16 that develops a latent image formed by the exposure device 14 with a toner in order to form a toner image, and the cleaning device 20 that removes a toner that remains on the surface of the image holding member 10 from which the toner image has been transferred, which are included in the above-described image forming apparatus illustrated in FIG. 4, by using a housing 24 including an opening 24A through which the image holding member is exposed to light, an opening 24B through which the image holding member is exposed to light for eliminating statistic, and an attachment rail 24C. The process cartridge 102 is detachably attached to the above-described image forming apparatus 101 illustrated in FIG. 4.

EXAMPLES

The above-described embodiments are described further in detail with reference to Examples below. However, the above-described embodiments are not limited to Examples. In Examples, "parts" always refers to "parts by weight" unless otherwise specified.

Preparation of Photosensitive Member

A honed hollow cylindrical aluminium support having an outside diameter ϕ of 84 mm is prepared.

Subsequently, 100 parts by weight of a zirconium compound "ORGATIX ZC540" produced by Matsumoto Fine Chemical Co. Ltd., 10 parts by weight of a silane compound "A1100" produced by Momentive Performance Materials Inc., 400 parts by weight of isopropanol, and 200 parts by weight of butanol are mixed together to prepare an undercoat-layer forming coating liquid.

The coating liquid is applied to the aluminium support by immersing the aluminium support in the coating liquid, and heating is performed at 150° C. for 10 minutes in order to dry the resulting coating film. Thus, an undercoat layer having a thickness of 0.1 μm is formed.

Subsequently, 1 part by weight of hydroxygallium phthalocyanine that had strong diffraction peaks at Bragg angles (2θ±0.2°) of 7.5°, 9.9°, 12.5°, 16.3°, 18.6°, 25.1°, and 28.3° in the CuKα X-ray diffraction spectrum, 1 part by weight of polyvinyl butyral "S-LEC BM-S" produced by SEKISUI CHEMICAL CO., LTD., and 100 parts by weight of n-butyl acetate are mixed together. The resulting mixture is subjected to a paint shaker with glass beads for one hour in order to prepare a dispersion. Thus, a charge-generating-layer forming coating liquid is prepared.

This coating liquid is applied to the undercoat layer by immersing the undercoat layer in the coating liquid. Heating is performed at 100° C. for 10 minutes in order to dry the resulting coating film. Thus, a charge generating layer having a thickness of about 0.15 μm is formed.

Subsequently, 2 parts by weight of the charge transporting material represented by Formula (V-3) below, 3 parts by weight of a high-molecular compound (viscosity-average molecular weight: 50,000) including the structural unit represented by Formula (V-4) below, and 20 parts by weight of chlorobenzene are mixed together to prepare a charge-transporting-layer forming coating liquid.

(V-3)

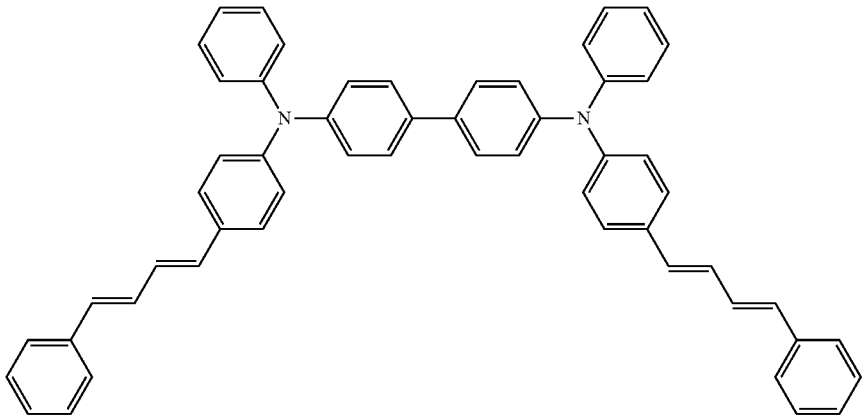

(V-4)

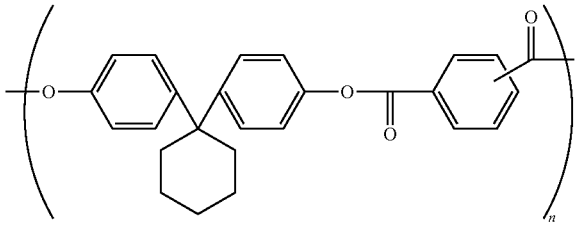

The charge-transporting-layer forming coating liquid is applied to the charge generating layer by immersing the charge generating layer in the coating liquid, and heating is performed at 110° C. for 40 minutes in order to dry the resulting coating film. Thus, a charge transporting layer having a thickness of 20 μm is formed.

In this manner, the undercoat layer, the charge generating layer, and the charge transporting layer are successively formed on and above the honed aluminium support. Thus, a photosensitive member is prepared.

Preparation of Charging Base Roller

Formation of Conductive Elastic Layer

A mixture having the composition described in Table 1 is kneaded with an open roller. The kneaded mixture is deposited on the surface of a conductive core bar made of SUS303 which had a diameter of 8 mm with an adhesive layer interposed between the core bar and the kneaded mixture using a press-forming machine. Thus, a roller having a diameter of 15 mm is formed. The roller is subsequently ground to prepare a charging base roller having a diameter of 14 mm. Note that the units of "Content" in Table 1 are in "parts by weight".

TABLE 1

| Composition of charging base roller Type of material | | A Content |
|---|---|---|
| Elastic material | Epichlorohydrin rubber | 95.6 |
| | Nitrile-butadiene rubber | 4.4 |
| Conductant agent | Benzyltriethylammonium chloride | 0.9 |
| | Carbon black | 15 |
| Vulcanizing agent | Sulfur | 0.5 |
| Vulcanization accelerator | Tetramethylthiuram disulfide | 1.5 |
| | Dibenzothiazyl disulfide | 1.5 |

TABLE 1-continued

| Composition of charging base roller Type of material | | A Content |
|---|---|---|
| Filler | Calcium carbonate | 20 |
| Vulcanization accelerator | Stearic acid | 1 |
| | Zinc oxide | 5 |

Confirmation of Pores

Whether the porous silica 1 and 2 in Table 2 are "porous" or not is confirmed by observing the secondary electron image thereof with an FE-SEM ("JSM-6700F" produced by JEOL, Ltd.) at an accelerating voltage of 5 kV. The results are as follows.

Porous silica 1 (SUNSPHERE H31, produced by AGC Si-Tech. Co., Ltd.): average particle diameter: 3 μm, pore diameter: 5 nm Porous silica 2 (SUNSPHERE H51, produced by AGC Si-Tech. Co., Ltd.): average particle diameter: 5 μm, pore diameter: 5 nm

Example 1

A mixture having the composition described in Table 2 (units of composition in Table 2 are all in parts by weight) is diluted with methanol, and the resulting diluent is subjected to a bead mill to prepare a dispersion liquid. The dispersion liquid is applied to the surface of the charging base roller by immersing the charging base roller in the dispersion liquid. Heating is performed at 180° C. for 30 minutes in order to dry the resulting coating film. Thus, an outermost layer having a thickness of 10 μm is formed. A charging roller E1 of Example 1 is prepared in the above described manner.

N-methoxymethylated polyamide "Toresin" produced by Nagase ChemteX Corporation is used as an N-alkoxymethylated polyamide, and "Monarch 1000" produced by Cabot Corporation is used as carbon black.

Examples 2 to 5

Charging rollers E2 to E5 are prepared as in the preparation of the charging roller E1 of Example 1, except that the outermost-layer forming coating liquid used is a dispersion liquid prepared by diluting a mixture having the composition described in Table 2 (units of the composition in Table 2 are all in parts by weight) with methanol and subjecting the diluent to a bead mill.

Comparative Examples 1 to 6

Charging rollers C1 to C6 are prepared as in the preparation of the charging roller E1 of Example 1, except that the outermost-layer forming coating liquid used is a dispersion liquid prepared by diluting a mixture having the composition described in Table 3 (units of the composition in Table 3 are all in parts by weight) with methanol and subjecting the diluent to a bead mill.

The nonporous spherical silica used is "SUNSPHERE NP-30" produced by AGC Si-Tech. Co., Ltd. Observation of the nonporous spherical silica which is made using an FE-SEM "JSM-6700F" produced by JEOL, Ltd. in the same manner as described above confirmed that the nonporous spherical silica did not have a porous structure.

The porous polyamide used is "ORGASOL 2001NAT" produced by Arkema.

Physical Properties of Charging Members

The surface roughness (i.e., ten-point average roughness) Rz of the outermost layer of each of the charging rollers prepared in Examples and Comparative examples and the gel fraction of the outermost layer are measured.

Surface Roughness

The ten-point average surface roughness Rz of the surface of each charging roller (i.e., the surface of the outermost layer) is measured in accordance with JIS B0601 (1994). Specifically, the surface roughness of the surface of each charging roller is measured over a length of 2.5 mm using a contact surface-roughness measuring device "SURFCOM 570A" produced by Tokyo Seimitsu Co., Ltd. is used at 23° C. and 55 RH % with a stylus having a diamond tip (5 μmR, 90° cone). The measurement is made three times at different positions, and the average thereof is considered to be the ten-point average surface roughness Rz of the surface of the charging roller.

Gel Fraction

The gel fraction of the outermost layer is measured in accordance with JIS K6796. Specifically, the weight of a piece taken from the outermost layer of each charging member is measured, which is considered to be the weight of a resin before being extracted with a solvent. The piece of the outermost layer is subsequently dissolved and immersed in methanol for 24 hours. A resin film that remained in the solution is separated by filtering, and the weight of the resin film is measured, which is considered to be the weight of the resin after being extracted. The gel fraction is calculated using the following expression.

$$\text{Gel Fraction (\%)}=((\text{Weight of Resin After Solvent Extraction})/(\text{Weight of Resin After Solvent Extraction}))\times 100$$

Evaluations

The photosensitive member prepared above is attached to an image forming apparatus "DocuCentre SC2021 CPS" produced by Fuji Xerox Co., Ltd. The initial charging characteristic (i.e., uniform-charging capability) and the durability and image quality (i.e., capability of maintaining the uniform-charging capability) of each of the charging rollers prepared in Examples and Comparative examples above are evaluated using the image forming apparatus by replacing a charging roller originally included in the image forming apparatus with the charging roller to be evaluated.

Initial Charging Characteristic

A 50% halftone image is printed on an A4 sheet of paper "$C^{2}$" produced by Fuji Xerox Co., Ltd. at 22° C. and 55% RH.

A: Streak-like image defects are absent.

B: Streak-like image defects are present, but negligible.

C: Streak-like image defects are slightly present, but acceptable.

D: Streak-like image defects are present.

E: Streak-like image defects are present in the most part of the printed image.

Evaluation of Durability and Image Quality

After a test printing of 50,000 A4 sheets of paper (50,000 sheets printed at 22° C. and 55 RH %) is conducted, a 50% halftone image is printed. The printed image is visually inspected and evaluated in accordance with the following criteria.

A: Streak-like image defects are absent.

B: Streak-like image defects are present, but negligible.

C: Streak-like image defects are slightly present, but acceptable.

D: Streak-like image defects are present.

E: Streak-like image defects are present in the most part of the printed image.

Tables 2 and 3 summarize the structure of the outermost layer of each charging member and the results of evaluation of the charging member.

TABLE 2

| | | | Example 1 | Example 2 | Example 3 | Example 4 | Example 5 |
|---|---|---|---|---|---|---|---|
| Composition of outermost layer of charging member | Resin | N-methoxymethylated polyamide | 100 | 100 | 100 | 100 | 100 |
| | Conductant agent | Carbon black | 17 | 17 | 17 | 17 | 17 |
| | Filler | Porous silica 1 (3 μm) | 10 | — | 5 | 50 | |
| | | Porous silica 2 (5 μm) | — | 10 | — | — | 50 |
| | Catalyst | Nacure4167 | 4.4 | 4.4 | 4.4 | 4.4 | 4.4 |
| Evaluations | Surface roughness Rz (μm) | | 4 | 6 | 2 | 17 | 20 |
| | Gel fraction (%) | | 96 | 90 | 94 | 94 | 92 |
| | Initial charging characteristics | | B | A | C | A | A |
| | Evaluation of durability and image quality | | A | A | A | C | C |

TABLE 3

| | | | Comparative example 1 | Comparative example 2 | Comparative example 3 | Comparative example 4 | Comparative example 5 | Comparative example 6 |
|---|---|---|---|---|---|---|---|---|
| Composition of outer-most layer of charging member | Resin | N-methoxymethylated polyamide | 100 | 100 | 100 | 100 | 100 | 100 |
| | Conductant agent | Carbon black | 17 | 17 | 17 | 17 | 17 | 17 |
| | Filler | Porous silica 1 (3 μm) | — | 3 | — | — | 10 | — |
| | | Porous silica 2 (5 μm) | — | — | 100 | — | — | — |
| | | Spherical silica (4 μm) | — | — | — | 10 | — | — |
| | | Porous polyamide (5 μm) | — | — | — | — | — | 10 |
| | Catalyst | Nacure4167 | 4.4 | 4.4 | 4.4 | 4.4 | 4.4 | 4.4 |
| Evaluations | Surface roughness Rz (μm) | | 0.6 | 1.8 | 21 | 6 | 4 | 4 |
| | Gel fraction (%) | | 88 | 89 | 91 | 95 | 30 | 95 |
| | Initial charging characteristics | | E | D | A | C | A | D |
| | Evaluation of durability and image quality | | A | A | D | E | D | A |

The above results show that the charging rollers prepared in Examples are rated higher than those prepared in Comparative examples in terms of charging characteristic (i.e., uniform-charging capability) and durability and image quality (i.e., capability of maintaining the uniform-charging capability).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging member comprising:

a conductive support; and an outermost layer disposed on the conductive support, the outermost layer including porous silica and an N-alkoxymethylated polyamide and having a gel fraction of 50% or more and a surface roughness Rz of 2 μm or more and 20 μm or less, wherein a content of the porous silica in the outermost layer is 1% by weight or more and 50% by weight or less; and the porous silica has an average particle diameter of 2 μm or more and 15 μm or less.

2. The charging member according to claim 1, wherein the content of the porous silica in the outermost layer is 3% by weight or more and 45% by weight or less.

3. The charging member according to claim 1, wherein the porous silica has an average particle diameter of 3 μm or more and 12 μm or less.

4. The charging member according to claim 1, wherein the surface roughness Rz is 2 μm or more and 18 μm or less.

5. The charging member according to claim 1, wherein the surface roughness Rz is 2 μm or more and 15 μm or less.

6. The charging member according to claim 1, wherein the content of the N-alkoxymethylated polyamide in the outermost layer is 20% by weight or more and 99% by weight or less.

7. The charging member according to claim 1, wherein the content of the N-alkoxymethylated polyamide in the outermost layer is 50% by weight or more and 95% by weight or less.

8. The charging member according to claim 1, wherein the N-alkoxymethylated polyamide is N-methoxymethylated polyamide.

9. A process cartridge detachably attachable to an image forming apparatus, the process cartridge comprising:

an image holding member; and a charging unit including the charging member according to claim 1, the charging unit charging a surface of the image holding member with the charging member being brought into contact with the surface of the image holding member.

10. An image forming apparatus comprising:

an image holding member;

a charging unit including the charging member according to claim 1, the charging unit charging a surface of the image holding member with the charging member being brought into contact with the surface of the image holding member;

a latent-image forming unit that forms a latent image on the charged surface of the image holding member;

a developing unit that develops the latent image formed on the surface of the image holding member with a toner in order to form a toner image; and a transfer unit that transfers the toner image formed on the surface of the image holding member to a recording medium.

* * * * *